US007946608B2

(12) United States Patent
Riepler et al.

(10) Patent No.: US 7,946,608 B2
(45) Date of Patent: May 24, 2011

(54) SKI OR SNOWBOARD WITH A PLATE-TYPE FORCE-TRANSMITTING ELEMENT

(75) Inventors: Bernhard Riepler, Wagrain (AT); Rupert Huber, Radstadt (AT); Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 668 days.

(21) Appl. No.: 12/009,111

(22) Filed: Jan. 16, 2008

(65) Prior Publication Data

US 2008/0185818 A1 Aug. 7, 2008

(30) Foreign Application Priority Data

Feb. 2, 2007 (AT) ..... A 172/2007

(51) Int. Cl.
*A63C 5/07* (2006.01)
*A63C 5/04* (2006.01)
*A63C 5/14* (2006.01)

(52) U.S. Cl. ..... 280/602; 280/607; 280/609; 280/610; 280/11.14; 280/11.15

(58) Field of Classification Search ..... 280/14.21, 280/14.22, 14.25, 14.26, 11.12, 601, 602, 280/607, 609, 610, 11.14, 11.18, 11.15, 600
See application file for complete search history.

(56) References Cited

U.S. PATENT DOCUMENTS 3,260,531 A 7/1966 Heuvel
3,260,532 A 7/1966 Heuvel
3,921,994 A 11/1975 Locati
5,183,618 A 2/1993 Pascal et al.
5,301,976 A * 4/1994 Stepanek et al. ..... 280/602
5,333,889 A * 8/1994 Piegay et al. ..... 280/602
5,366,234 A 11/1994 Rohrmoser
(Continued)

FOREIGN PATENT DOCUMENTS

AT 376 373 11/1984
(Continued)

OTHER PUBLICATIONS

European Search Report dated Apr. 9, 2008 with English translation of relevant parts.

*Primary Examiner* — Hau V Phan
*Assistant Examiner* — John R Olszewski
(74) *Attorney, Agent, or Firm* — Collard & Roe, P.C.

(57) ABSTRACT

The invention relates to a ski (2) or a snowboard in the form of a board-type gliding device (1), comprising a multi-layered gliding board body. A force-transmitting element (13) is supported on the top face (7) of the gliding board body, the top face of which is provided as a means of supporting a binding mechanism (3) for a connection to a sports shoe which can be released as and when necessary. The force-transmitting element (13) is of a plate-type design and extends across more than 50% of the length of the gliding board body. Within its longitudinal extension, the plate-type force-transmitting element (14) is supported in at least part-portions on the top face (7) of the gliding board body so as to transmit load and is connected to the gliding board body by means of a plurality of connecting zones (30) disposed in the longitudinal direction of the plate-type force-transmitting element (13).

22 Claims, 5 Drawing Sheets

U.S. PATENT DOCUMENTS

| | | | | |
|---|---|---|---|---|
| 5,393,086 | A * | 2/1995 | Le Masson et al. | 280/602 |
| 5,447,322 | A * | 9/1995 | le Masson et al. | 280/602 |
| 5,785,342 | A * | 7/1998 | Bronson | 280/602 |
| 5,820,154 | A | 10/1998 | Howe | |
| 6,679,513 | B1 | 1/2004 | Emig et al. | |
| 6,755,434 | B2 * | 6/2004 | Deborde et al. | 280/602 |
| 7,185,908 | B2 | 3/2007 | Emig | |
| 7,338,066 | B2 * | 3/2008 | Riepler | 280/610 |
| 7,357,405 | B2 * | 4/2008 | Leitner | 280/601 |
| 7,520,525 | B2 | 4/2009 | Ableidinger et al. | |
| 2002/0158430 | A1 * | 10/2002 | Farcot et al. | 280/14.21 |
| 2004/0227311 | A1 * | 11/2004 | Sanders | 280/14.22 |
| 2005/0127639 | A1 * | 6/2005 | Sanders | 280/610 |
| 2006/0012150 | A1 * | 1/2006 | Zanco et al. | 280/602 |
| 2006/0103112 | A1 * | 5/2006 | Redor et al. | 280/607 |

FOREIGN PATENT DOCUMENTS

| | | | |
|---|---|---|---|
| AT | 007 540 | | 5/2005 |
| DE | 24 17 156 | | 11/1974 |
| DE | 38 03 483 | | 9/1988 |
| DE | 41 30 110 | | 4/1992 |
| DE | 198 36 515 | | 2/1999 |
| DE | 101 26 121 | | 12/2002 |
| EP | 0 490 043 | | 6/1992 |
| EP | 0 490 044 | | 6/1992 |
| EP | 542123 | A1 * | 5/1993 |
| WO | WO 95/33536 | | 12/1995 |
| WO | WO 00/10659 | | 3/2000 |
| WO | WO 00/62877 | | 10/2000 |
| WO | WO 2004/045727 | | 6/2004 |

* cited by examiner

SKI OR SNOWBOARD WITH A PLATE-TYPE FORCE-TRANSMITTING ELEMENT

CROSS REFERENCE TO RELATED APPLICATIONS

Applicants claim priority under 35 U.S.C. §119 of AUSTRIAN Patent Application No. A 172/2007 filed on Feb. 2, 2007.

BACKGROUND OF THE INVENTION

1. Field of the Invention

The invention relates to a ski or a snowboard in the form of a board-type gliding device, of the type defined in claim 1.

2. Prior Art

Patent specification DE 24 17 156 A1 describes a ski comprising at least two sliding strips disposed adjacent to one another. These gliding strips are connected to one another by fixing means to enable a relative movement of the two gliding strips, at least in their middle portion, in the vertical direction with respect to their gliding surface. This produces a multiple, in particular twofold edge support, which is intended to permit a better grip to prevent lateral skidding. The mechanical coupling between the two gliding strips requires complex mechanisms, which means that a design of this type is not especially suitable in practical terms.

Patent specification DE 41 30 110 A1 describes a ski with a three-dimensionally profiled top face. The ski is formed by a one-piece composite body made up of a plurality of layers or plies adhesively joined to one another. In particular, this one-piece ski comprises a top belt, a bottom belt, side faces and a core surrounded by these elements. The top belt is made up of several layers. An intermediate layer is disposed between a layer of the top belt and a superficial layer or the core, which has a different thickness and/or width in the longitudinal direction. This intermediate layer may incorporate a support and/or damping element or may be provided in the form of one. The ski binding is attached by fixing means, such as screws for example, to the one-part ski, for example via the intermediate layer and/or the core. In particular, the binding fixing screws extend into the core element of the ski and terminate short of the bottom face of the ski. The top belt construction adhered or integrally formed on the top face of the ski body incorporating varying stepped width and/or thickness dimensions therefore affects the stiffness curve of the one-piece, multi-layered ski in steps. A ski of this type is also of a relatively stiff design in the region of the binding mounting zone, especially when a shoe is inserted in the ski binding.

Patent specification WO 00/62877 A1 describes an alpine ski with a body made up of several elements, which has a running surface on its bottom face and a region on its top face for attaching a binding. This structure also has at least one top belt element which is primarily subjected to compression and at least one bottom belt element which is subjected to tension. The top belt element has a flat, upwardly cambered arch in the middle region of the ski, which extends in the longitudinal direction of the ski and spans the bottom belt element. The arch of the top belt element is therefore able to flex in the direction towards the bottom belt element depending on the load emanating from the binding. At the end regions of the ski, the top belt element is supported so that the shift in the ends of the top belt element caused by the flexing of the arch increases the amount of support afforded by the end regions of the ski. This design enables a more uniform distribution of surface pressure across the running surface of the ski to be obtained. The highest possible support length of the ski edges can also be achieved, which slightly improves stability when travelling in a straight line as well as the reaction of the alpine ski to control pulses of the skier. However, the travel dynamics or the enjoyment which can be achieved with this design is still not satisfactory for many skiers.

Patent specification WO 2004/045727 A1 describes an alpine ski with a ski body, which has a running surface on its bottom face and, on a top face, facing away from its running surface, at least one top belt element extending in the longitudinal direction of the ski body which absorbs tension and compression forces. This top belt element is supported on the ski body by its ends, and a wave-shaped support structure is provided on the top face of the ski body, on which the top belt element is mounted. The wave-shaped support structure is formed by a longitudinally extending flat component, which is bent at an angle with respect to the running surface about spaced apart, essentially parallel axes extending transversely to the longitudinal direction of the ski. This is intended to produce good running properties and good controllability of the alpine ski. In particular, a good compromise can be obtained between the desired bending elasticity on the one hand and the required torsional strength of the ski on the other hand. A uniform distribution of surface pressure is advantageously also obtained. However, the travel dynamics which can be achieved are satisfactory for only a limited number of skiers.

Patent specification DE 198 36 515 A1 filed by this applicant discloses a distribution mechanism for transmitting loads and/or forces on a sports device, as well as a sports device incorporating same. The distribution mechanism comprises a support element for a coupling mechanism designed to retain the sports shoe of a user. This plate-type support element for the coupling mechanism can be connected to a board-type sports device, in particular a ski, at its end regions by means of articulated joint arrangements. At least one end region of the plate-type support element is connected to an intermediate support so that it can pivot via an articulated joint arrangement, which in turn is supported on the board-type sports device and/or on another support holder by means of two articulated joint arrangements spaced at a distance apart from one another in the longitudinal direction towards the support element. By means of this support construction comprising a plate-type support element for the coupling mechanism and several intermediate supports and articulated joint arrangements disposed between the top face of the sports device and the support element, the forces to be transmitted from the support element to the sports device, in particular emanating from the middle region, are distributed as uniformly as possible. The disadvantage of this approach is that the arcuate intermediate support and the respective linking articulated joint arrangements increase the complexity of the structure, thereby making the overall weight of such a sports device relatively high. Furthermore, the standing height for the foot of the user is relatively high compared with the running or gliding surface of the sports device, and the various articulated joint arrangements and longitudinal guides do not guarantee the desired ability to turn and slide longitudinally between the respective components under adverse usage conditions to a sufficiently high degree.

Patent specifications U.S. Pat. No. 3,260,531 A and U.S. Pat. No. 3,260,532 A describe designs for distributing forces and affording support similar to that outlined in respect of the publication above. These designs are intended to result in a ski which is capable of adapting to different types of terrain as far as possible, due to a high flexibility and as low a torsional stiffness as possible. To this end, it is proposed that elastic and/or articulated or length-compensating coupling mechanisms be provided between a support plate for the user's shoe and the actual gliding board body. These designs, which are also intended to enable the gliding board body to be optimally adapted to the respective nature of the ground, also fail to offer the user satisfactory gliding and guiding properties. In particular, the controllability of such ski designs is not very satisfactory for the user.

SUMMARY OF THE INVENTION

The underlying objective of this invention is to propose a ski or a snowboard with improved travel properties, resulting in the best possible performance which can be achieved when using such a gliding board body. In particular, the intention is to obtain improved turning behaviour.

This objective is achieved by the invention on the basis of a board-type gliding device incorporating the characterizing features defined in claim 1. The essential factor is that the ski proposed by the invention or the snowboard proposed by the invention offers significant advantages over board-type gliding devices known from the prior art in terms of its travel properties. In particular, a ski or snowboard is proposed, the vibration behaviour and hence also travel behaviour of which is significantly influenced by the plate-type force-transmitting element, so that the claimed winter sports devices above all produce an excellent edge-gripping capacity or tracking capacity, which is extremely important in terms of accurate turning, especially when initiating a turn. In particular, the specified plate-type force-transmitting element imparts to the gliding board body exactly the desired stability or strength to enable cut or so-called "carved" turns to be made in the snow as safely and controllably as possible. The claimed board-type gliding device therefore gives the user the requisite, sufficiently high stability and imparts a high controllability or guiding stability to the gliding device as a whole. Above all, as the load on the gliding device increases during a turning phase, the gliding board body in contact with the ground underneath unexpectedly flexes or virtually kinks, causing the board-type gliding device to suddenly assume a behaviour that is difficult to control. In particular, a harmonic or uniform turning action can be generated within a relatively high load region of the gliding board body, which also increases personal safety when using the gliding board body proposed by the invention. The specified plate-type force-transmitting element therefore stabilises the gliding board modified as claimed, resulting in good controllability and a conducive guiding behaviour. In particular, the plate-type force-transmitting element suppresses or reduces high-frequency vibrations in the vertical direction with respect to the running surface facing, at least in an end portion of the gliding board body, such as primarily occur when travelling at speed over rough slopes, especially when turning, which is an advantage. Another advantage is the fact that the forces applied by the user or the control movements initiated by the user via the interconnected force-transmitting element can be introduced into exactly those portions of the gliding board body in which the plate-type force-transmitting element is able to produce the most pronounced or best effect with respect to the gliding board body.

The advantage of the features defined in claims 2 and 3 is that within the at least one connecting zone, planar relative movements can occur between the plate-type force-transmitting element and the gliding board body, and these relative movements are countered by an elastically flexible resistance. In particular, these relative movements are whipped and gradually restricted after covering a defined path of relative movement. This path restriction is dependent on load or force. Especially if the prevailing deformation force is no longer high enough to overcome the elastic deformation resistance, a relative movement between the plate-type force-transmitting element and the gliding board body which is dependent on the degree of flexing can be gradually halted.

An embodiment defined in claim 4 is also of advantage because it offers a particularly robust, elastically flexible connecting means between the plate-type force-transmitting element and the gliding board body. In particular, the elastomeric damping element is reliably retained and mounted as a result and is therefore able to withstand relatively high loads without any risk of the damping element tearing or shearing off. Also of particular advantage is the fact that the damping element is disposed in the plate-type force-transmitting element and not the gliding board body. This offers a simple way of producing different characteristics by fitting different force-transmitting elements and damping elements to a standard gliding board body. In particular, a specific type of gliding board body can be selectively fitted with the plate-type force-transmitting element or not, which offers economic advantages for producers and/or relatively low costs for users of the gliding board bodies.

The advantage of an embodiment defined in claim 5 is that a connection can be obtained between the plate-type force-transmitting element and the gliding board body which is particularly resistant to breaking and tearing out. In addition, the production complexity involved in manufacturing the board-type gliding device can be kept to a minimum because a relatively short time is needed to assemble the connection between the plate-type force-transmitting element and the gliding board body. Moreover, the board-type gliding devices produced as a result will remain functionally reliable for a long time and their properties will remain largely constant even after long-term or intensive use. In particular, it is possible to prevent fixing screws from gradually working loose due to widening of the material more easily, thereby providing a firm seating for the fixing screws. Also as a result, it is possible to produce gliding board bodies or board-type gliding devices made up of two or more parts which, in terms of their overall height, are relatively low, because it is possible to manage with relatively short screwing-in depths for the fixing screws of the plate-type force-transmitting element. In particular, it is possible to obtain the requisite resistance to tearing out or a good connection quality between the plate-type force-transmitting element and the gliding board body in spite of the relatively slim thickness of the gliding board body and in spite of a relatively short screwing-in depth.

Due to the features defined in claim 6, based on a plan view of the plate-type force-transmitting element, damping elements with a relatively large surface area can be used, which have optimized damping characteristics and elasticity. In addition, the mechanical strain of such damping elements can be kept to a minimum due to their relatively wide extension. The damping element is also easily and reliably prevented from falling out or being torn out of the plate-type force-transmitting element. As a result, it is also optionally possible to use standard, readily available fixing screws to provide the mechanical coupling between the plate-type force-transmitting element and the gliding board body, thereby enabling the overall cost of manufacturing the board-type gliding device to be kept to a minimum.

As a result of the features defined in claim 7, the stabilization function and simultaneously the damping function of the plate-type force-transmitting element can be transmitted to appropriately extensive longitudinal portions of the gliding board body. In particular, the multi-functional action, i.e. the damping and stabilization action, of the plate-type force-transmitting element is imparted in full to the gliding board body without the need for any structurally complex features.

The embodiment defined in claim 8 is of advantage because the force-transmitting element is able to act on the gliding board body with a high degree of effectiveness due to the fact that the force-transmitting element extends across extensive portions of the gliding board body. In particular, such a force-transmitting element acts on the gliding board body close to the end portions of the gliding board body, which on the one hand affords a good stabilizing function and on the other hand produces sufficiently pronounced damping or springing of the gliding board body in at least one of its end portions.

Also of advantage is an embodiment defined in claim 9, because a highly stable coupling is achieved and force is transmitted directly and as far as possible without delay between the force-transmitting element and the gliding board body. Furthermore, the requirements placed on the screw connection, in particular the anchoring strength or tearing resistance, can be reduced but a highly stable coupling can nevertheless be obtained between the force-transmitting element and the gliding board body.

Also of particular advantage is an embodiment defined in claim 10. This construction results in a bigger screwing-in depth and a longer active thread length for the screw-type fixing means of the binding mechanism, which results in a high degree of resistance to the screw-type fixing means tearing out. The thickness or vertical height of the plate-type force-transmitting element can therefore be selected so that it is relatively short, which means that the overall height of the gliding device, in particular the standing height of the user of the gliding device from the ground underneath, can also be kept low, even though the gliding board body has a plate-type force-transmitting element mounted on the top of it. In particular, this means that a relatively long overall or thread length can be selected for the screw-type fixing means of the binding mechanism, in which case these screw-type fixing means are anchored exclusively in the plate-type force-transmitting element but are nevertheless reliably prevented from tearing out. In particular, the screw-type fixing means do not penetrate the top face of the gliding board body lying underneath, but a sufficient resistance to tearing out is obtained even though the screw-type fixing means are not anchored in the gliding board body. This is accompanied by a conducive bending behaviour for the gliding board body, in particular an improved bending characteristic curve, because the gliding board body remains elastically deformable in a relatively homogeneous shape in wide part-portions relative to the plate-type force-transmitting element.

The advantage offered by the features defined in claim 11 is that, in spite of opting for a relatively slim plate height for the plate-type force-transmitting element, a high tearing resistance is obtained for the screw means used to assemble a binding mechanism. Nevertheless, the plate-type force-transmitting element with the binding mechanism affixed to it is still able to slide as freely as possible in the longitudinal direction relative to the gliding board body disposed underneath it, so that tensions between said components caused by flexing are avoided as far as possible during flexing.

The advantage of the embodiment defined in claim 12 is that a guide mechanism extending in the longitudinal direction of the gliding device is provided, which increases transverse stability between the plate-type force-transmitting element and the gliding board body. In particular, this enables strong forces to be transmitted between the gliding board body and the plate-type force-transmitting element without the occurrence of shifting movements and without incurring an increased risk of damage to said components. Due to the partially positive coupling between the plate-type force-transmitting element and the gliding board body, the extra connecting elements which are needed between said components, in particular fixing screws, may be of a lower rating and/or their number may be reduced and/or their positioning can be optimized.

Also of advantage are the features defined in claim 13, because in those portions in which the gliding board body and/or the plate-type force-transmitting element has its biggest thickness or width, a more pronounced positive connection is established, which increases the quality of the connection between said components. By contrast, the positive connection established in those portions of the gliding device where the gliding board body and/or the force-transmitting element has a relatively slimmer thickness or height is less pronounced. In particular, this avoids any additional weakening of the gliding board body in those portions which are or a relatively low height. Another advantage of this embodiment resides in the fact that, due to the elongate, positive coupling, a high resistance to twisting is achieved between the plate-type force-transmitting element and the gliding board body by reference to an axis extending perpendicular to the running surface facing.

The advantage of the features defined in claim 14 is that a pronounced, positive coupling can be established between the force-transmitting element and the gliding board body without having to drastically modify the standard structural design of a gliding board body, in particular an alpine ski, in order to produce the requisite load-bearing capacity and make the distal end portions of the gliding board body advantageously lightweight. In particular, virtually standard construction methods that have been tried and tested in practical applications can be used to make the gliding device proposed by the invention incorporating the gliding board body and the force-transmitting element mounted or supported on it as inexpensively as possible and in a proven way.

Also of particular advantage is the embodiment defined in claim 15, because tensions are prevented between the plate-type force-transmitting element and the gliding board body as far as possible. In particular, this also ensures that the end portions of the plate-type force-transmitting element are able to travel a correspondingly wide path of movement relative to the gliding board body when the gliding board body and the plate-type force-transmitting element are subjected to an elastic flexing movement, such as occurs when travelling over bumps and above all when turning, for example. This promotes a sufficiently pronounced influence on the cross-sectional or side edge geometry of the gliding device. It also ensures that the gliding board body has an ideal bending characteristic curve as far as possible because its bending behaviour is influenced by the plate-type force-transmitting element as little as possible, especially in the region of the mounting zone for a binding mechanism, which means that a bending characteristic curve can be achieved which is as harmonious and uniform as possible. Due to the features defined in claim 15, a packet of board-type or plate-type elements is obtained, as it were, which permits relative movements between the bottom face of the plate-type force-transmitting element and the top face of the gliding board body in the longitudinal direction when the overall construction is subjected to an arcuate, elastic flexing. At the same time, a higher resistance counters deviating or shifting movements in the transverse direction with respect to the longitudinal axis of the gliding device and such transverse shifting can be prevented as far as possible. This also improves the travel or gliding behaviour of the ski or snowboard proposed by the invention.

The advantage of the embodiment defined in claim 16 is that a particularly stable and strong connection can be obtained between the plate-type force-transmitting element and the binding mechanism or one of its components, even if the plate-type force-transmitting element has a relatively short plate height or plate thickness within the mounting zone for the binding mechanism. In particular, the plate height or plate thickness of the plate-type force-transmitting element can be kept relatively short but a sufficiently strong connection strength or connection stability can still be guaranteed between the plate-type force-transmitting element and the binding mechanism. This advantageously enables the overall height comprising the plate thickness of the plate-type force-transmitting element and the thickness or height of the gliding board body to be kept relatively short so as to avoid unfavourably high standing heights for the user from the ground underneath, in particular the ski slope, in certain instances.

The advantage of the embodiment defined in claim 17 is that the end user has the impression of having a mounting for the binding mechanism and its guide tracks on the plate-type force-transmitting element which has no screws. In particular, the structural combination of the binding mechanism or its guide tracks and the plate-type force-transmitting element gives the visual appearance of being cast in one piece as a result, which firstly results in an attractive visual appearance. In addition, the blind bores extending from the bottom to the top through the binding mechanism or its guide rails prevent water from being able to collect in the seating bores for the connecting screws, which can generally lead to the formation of rust and/or cause damage if water that has penetrated the seating bores freezes and loosens the correct seating of a screw or screws or damages parts of the binding mechanism. In addition to the advantages of visual appearance and strength, the connection quality between the plate-type force-transmitting element and the binding mechanism or its components is also improved.

The advantage offered by the embodiment defined in claim 18 is that the standing height of the user of the board-type gliding device from the ground underneath, in particular from the ski slope, is not significantly increased due to the extra plate-type force-transmitting element mounted on the top face of the gliding board body. In particular, the component unit comprising the plate-type force-transmitting element and the gliding board body within the binding mounting portion is of a relatively low design. Consequently, it is possible to cater for the individual wishes or requirements of different users as regards the standing height above the ground, in particular above a ski slope, more easily and in a simple manner because respectively adapted binding mechanisms and co-operating interconnected guide rails or binding plates make it relatively easy to adapt to respective wishes or requirements within a relatively broad range of adaptation. In particular, the user can choose between a relatively low standing height and a relatively high standing height from the ground underneath. Furthermore, without any difficulty, allowance can be made above all for the rules which apply to competitive sports with regard to the maximum permissible standing height of the user from the ground underneath or from the bottom face of the gliding device. This also applies in the case of standard binding mechanisms with a predefined structural height mounted on the top face of the plate-type force-transmitting element.

The embodiment defined in claim 19 is of advantage because a so-called sandwich compound element is produced, which acts as a plate-type force-transmitting element. In particular, this is based on a design construction which has been tried and tested for many years in the production of board-type gliding devices, in particular winter sports devices. Above all, a particularly stable plate-type force-transmitting element which best meets current requirements is obtained, the manufacturing costs of which can be kept to a minimum because the equipment and materials conventionally used by producers of the gliding device can also continue to be used or employed to produce the plate-type force-transmitting element. Furthermore, plate-type force-transmitting elements can be produced which offer a good ratio between strength and lightness of weight. Also of particular advantage is the fact that the plate-type force-transmitting element is ideally able to assume the function for imparting some of the requisite static overall strength, which means that the gliding board body lying underneath can be made to correspondingly smaller dimensions in terms of its structure, without causing problems with regard to robustness or every day use of the gliding device as a whole.

The features defined in claim 20 result in a plate-type force-transmitting element which advantageously meets current technical requirements. In particular, such a force-transmitting element is able to withstand prevailing stresses without any difficulty and the requisite forces can be transmitted and absorbed with a high degree of reliability. Such a plate-type force-transmitting element is also relatively lightweight but still of a sufficiently stable design. Another major advantage resides in the fact that the components needed to produce the structure of conventional skis or snowboards can also be used for the plate-type force-transmitting element, thereby making production as cost-effective as possible. This production cost advantage is further enhanced due to the fact that the machinery used to produce conventional skis or snowboards can also be used to produce the plate-type force-transmitting element, which makes production of a gliding device proposed by the invention economic for the manufacturer. Moreover, existing know-how involved in producing skis or snowboards can also be used to produce high-quality plate-type force-transmitting elements. Another major advantage resides in the fact that it is possible to produce an extremely attractive and advantageous visual appearance of the gliding device because the plate-type force-transmitting element and the actual gliding board body are able to form what is visually a relatively homogenous appearance with a designer look. In particular, the decorative methods or decorative options which are used on conventional skis and snowboards and have proved themselves in practical application can also be used for the plate-type force-transmitting element. In particular, the appearance of the plate-type force-transmitting element can be ideally combined with the appearance of the gliding board body disposed underneath it. This firstly results in a good and harmonious appearance and also simplifies technical production, resulting in better economy, amongst other things.

The features defined in claim 21 primarily result in a force-transmitting element which satisfies requirements in terms of strength, design and economy.

As a result of the embodiment defined in claim 22, the plate-type force-transmitting element affords a relatively high stability or torsional strength in spite of having a relatively low height. A relatively lightweight and at the same time relatively stable plate-type force-transmitting element can be produced especially if the width contour of the plate-type force-transmitting element more or less conforms to the width contour of the gliding board body, and the width dimensions of the plate-type force-transmitting element essentially correspond to the width dimensions of the gliding board body or are only negligibly smaller.

The features defined in claim 23 produce a longitudinal compensation that is as obstacle-free as possible between the plate-type force-transmitting element and the gliding board body, which more easily results in improved bending behaviour, in particular a bending characteristic curve of the overall construction that is as ideal as possible. Furthermore, such longitudinal compensating movements can be converted as effectively as possible into springing or damping movements with respect to the gliding board body. This also prevents the appearance of abrasion or scratches so that the attractive appearance of the ski or snowboard in the region of the zones of relative movement between the force-transmitting element and the gliding board body are preserved for a long time.

BRIEF DESCRIPTION OF THE DRAWINGS

Advantageous embodiments of the invention will be described in more detail below with reference to examples of embodiments illustrated in the appended drawings. Of these.

DETAILED DESCRIPTION OF PREFERRED EMBODIMENTS

Figure 1:
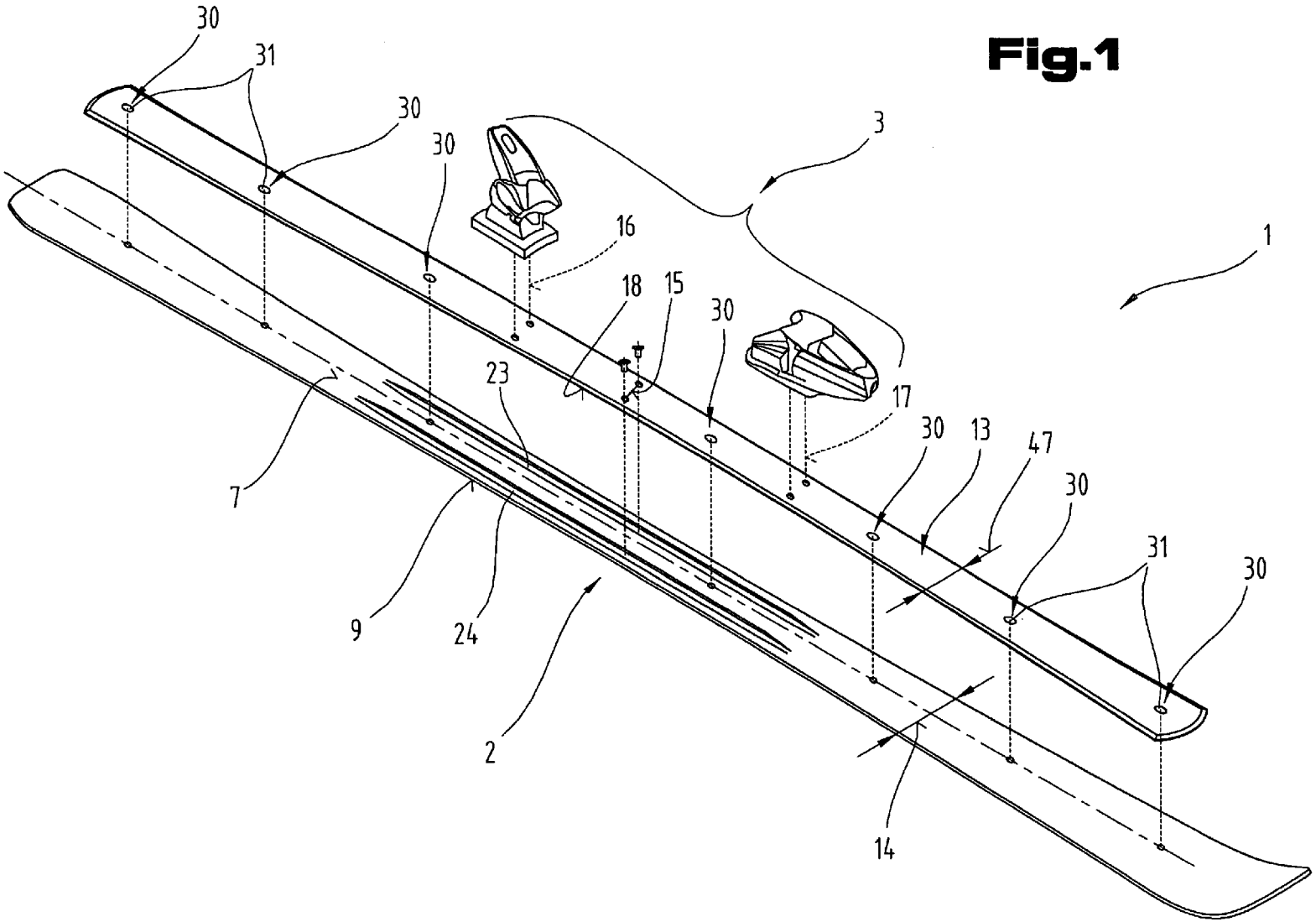
FIG. 1 is a simplified, perspective view of a board-type gliding device in the form of a ski, in particular a gliding board body with a plate-type force-transmitting element mounted on its top face.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc, relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIGS. 1 to 5 illustrate a preferred embodiment of a board-type gliding device 1 with improved travel properties, in particular pronounced damping and springing properties. In particular, a ski 2 is schematically illustrated, the gliding and turning behaviour of which as well as the natural dynamics are of advantage for a plurality of users. Only the most essential components are illustrated as examples in these drawings. Also in the individual drawings, only the most essential part-components are illustrated, in particular those of the gliding board base body and the plate-type force-transmitting element.

The board-type gliding device 1 is preferably a ski 2 or a snowboard. In a manner known per se, such a ski 2 is used in pairs, whereas the user of a snowboard is supported with both feet on a single board body. In order to connect the feet of the user to the gliding device 1, the latter has a least one binding mechanism 3, which may be designed as a safety-release binding or a binding which provides a coupling without flexing.

The board-type gliding device 1 is based on a sandwich or monocoque structure. In other words, a plurality of layers are joined to one another by adhesive and together constitute the one-piece gliding device body. In a known manner, these layers form at least one top belt 4 which imparts strength, at least one bottom belt 5 which imparts strength and at least one core 6 disposed in between. The top belt 4 and/or the bottom belt 5 may be made from at least one plastic layer and/or metal layer and/or fibre layer and/or epoxy resin layer and such like. In a known manner, the core 6 may be made from wood and/or from foamed plastics. The core 6 therefore essentially spaces the top belt 4 apart from the bottom belt 5 of the gliding device 1, both of which are impart strength.

Figure 4:
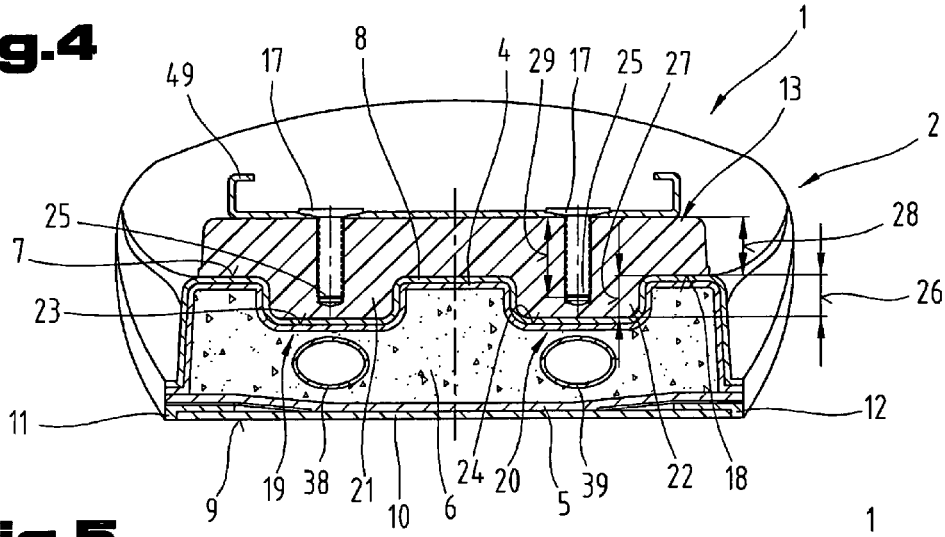
FIG. 4 shows the ski illustrated in FIG. 3, viewed in section along line IV-IV indicated in FIG. 3.

The top face 7, i.e. the top external face of the gliding device 1, is formed by a top layer 8, which primarily fulfils a protective and decorative function. The bottom face 9, i.e. the bottom surface of the gliding device 1, is formed by a running surface facing 10, which should have the best possible gliding properties with respect to the ground underneath, in particular with respect to snow or ice. In this respect, the top layer 8 may also extend across at least certain regions of the side faces of the board-type gliding device 1 and form a box-type structure in conjunction with the running surface facing 10, as may be seen in particular from the diagram in cross section shown in FIG. 4. The side edges of the running surface facing 10 are preferably bounded by control edges 11, 12, preferably made from steel, to permit an exact as possible and largely slip-free guiding action of the gliding device 1. The control edges 11, 12 which are key to controlling and guiding the gliding device 1, are rigidly joined to the structure, in particular to the running sole or bottom belt 5 of the gliding device 1. The control edges 11, 12 are preferably positively and non-positively fixed in the gliding device structure in a manner known per se. Similarly, the running surface facing 10 is permanently joined to the gliding device structure, in particular to its bottom belt 5, across its entire top flat face directed towards the core 6. The running surface facing 10 is preferably adhered to the surrounding components of the gliding device 1 by its entire surface. The running surface facing 10 or bottom face 9 of the gliding device 1 is of a flat or straight design as viewed in cross-section through the binding mounting portion, as illustrated in FIG. 4, when the gliding device 1 is in its original state not placed under load, in which case the gliding device 1 in the initial state free of load has an essentially flat bottom face 9 and running sole.

The structure described above is decisive in determining the strength, in particular the bending behaviour and torsional stiffness, of the board-type gliding device 1. These strength values are predefined or predetermined by the materials used and layer thicknesses and by the methods used for joining purposes. The essential factor is that at least one plate-type force-transmitting element 13 is supported on the top face 7 of the actual gliding board body, at least within part-portions, and transmits force or load. A contour or lateral shape of the gliding device 1 defined by its design results in a varying width 14 of the gliding device 1 and/or the plate-type force-transmitting element 13 in the longitudinal direction of the gliding device 1, as may best be seen from FIGS. 2, 3. In one advantageous embodiment, in addition to the actual gliding board body—FIG. 2—the plate-type force-transmitting element 13 also has a so-called shaping, specifically provided in the form of arcuate indentations at the longitudinal side edges of the plate-type force-transmitting element 13, imparting a substantially concave contour to the plate-shaped force-transmitting element 13 as seen in plan view. The shaping or the side shape of the plate-type force-transmitting element 13 therefore more or less conforms to or is essentially the same shape as the shaping or side shape of the gliding board body, as illustrated by way of example in FIG. 3. However, the width 47 of the plate-type force-transmitting element 13 is preferably selected so that it is smaller at all the longitudinal portions than the corresponding width 14 of the gliding board body within the same or congruent longitudinal portions. By preference, the plate-type force-transmitting element 13 does not therefore project beyond the longitudinal side edges of the gliding board body. In spite of providing a highly effective plate-type force-transmitting element 13, the gliding device 1 offers high personal safety and a high degree of safety against injury.

In particular, pronounced changes in travel behaviour can be achieved by means of the plate-type force-transmitting element 13, particularly with regard to the gliding behaviour and natural dynamics or so-called "rebound" when the gliding device 1 is relieved of load, which occurs in particular when turning, without the need for complex or expensive features or features which would significantly increase the weight of the ski 2. Altered accordingly, the travel behaviour of such a ski 2 is clearly felt or perceived even by users with average skiing ability or users who ski only occasionally. Consequently, its use is rendered more acceptable and the pleasure of using such skis 2 is significantly enhanced.

Figure 3:
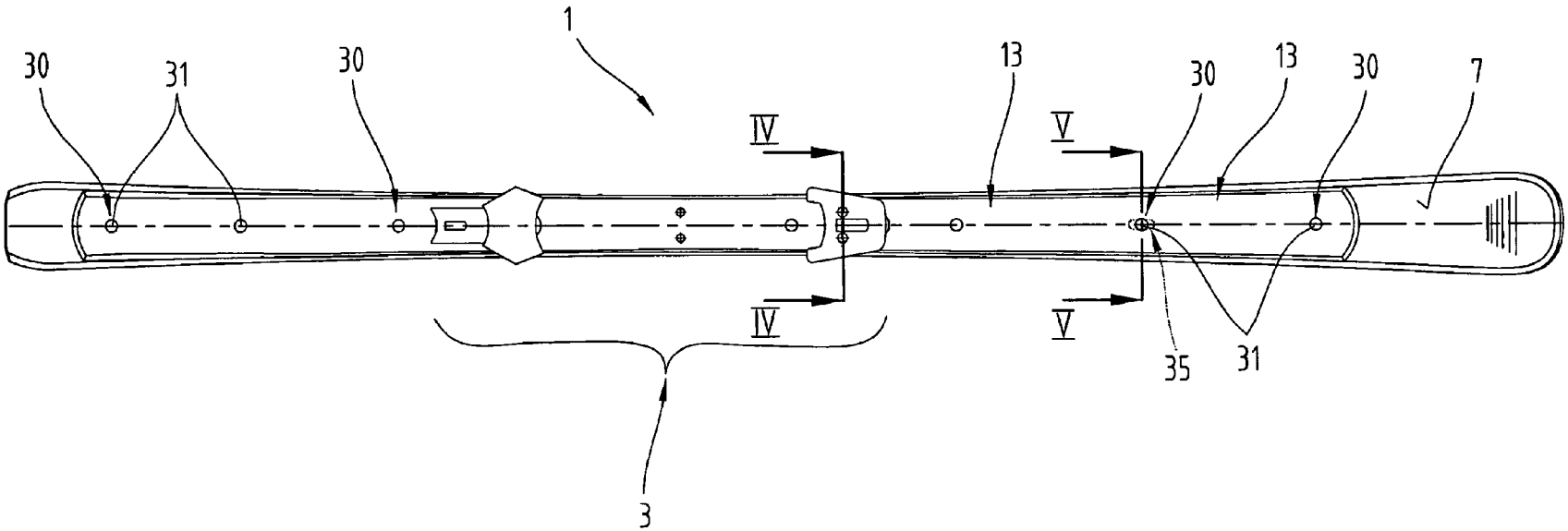
FIG. 3 is a view from above showing a ski similar to that shown in FIG. 1.

The plate-type force-transmitting element 13 preferably extends from the binding mounting portion in the direction towards the rear end portion and in the direction towards the front end portion of the gliding board body, as may best be seen from the diagrams shown in FIGS. 1 and 3. This makes it possible to vary the travel behaviour of the gliding board body significantly by means of the plate-type force-transmitting element 13 and impart a pronounced influence to it.

The distal ends of the force-transmitting element 13 are able to move relative to the top face 7 of the gliding board body in its longitudinal direction so that relative movements are possible between the force-transmitting element 13 and the gliding board body when the co-operating gliding device 1 is subjected to flexing or bending.

As may best be seen from FIG. 4, the top layer 8 of the gliding board body is preferably provided in the form of a plastic layer, which is decorated on at least one side. This top layer 8 forms the predominant portion of the top face 7 of the gliding board body. This top layer 8 preferably also lines at least part-portions of the external longitudinal side walls, as may best be seen from FIGS. 3, 4.

The plate-type force-transmitting element 13 is supported within its longitudinal extension, in at least part-portions, on the top face 7 of the gliding board body and transmits loads or forces. In the embodiment illustrated, the bottom face of the plate-type force-transmitting elements 13 is supported on the top face 7 of the gliding board body by virtually its entire surface. Alternatively, it would also be possible to provide individually disposed support zones on the bottom face of the plate-type force-transmitting element 13 for the top face 7 of the gliding board body. This being the case, the support zones in at least the end portions of the force-transmitting element 13 are positioned so that the plate-type force-transmitting element 13 is supported on the gliding board body disposed underneath so as to transmit load or forces, at least in its end portions.

In order to produce advantageous effects, it is expedient if the plate-type force-transmitting element 13 extends from a binding mounting centre point 15, provided by the manufacturer of the gliding board body, across more than 50% of the length as far as the rear end of the gliding board body and at the same time extends across more than 50% of the length as far as the front end of the gliding board body. It is of advantage if the force-transmitting element 13 extends across approximately 51% to approximately 96%, preferably across 66% to 86%, of the projected length of the gliding board body. By projected length is meant the length of the gliding board body as viewed from above. The longitudinal extension of the plate-type force-transmitting element 13 is essentially limited by the fact that the plate-type force-transmitting element 13 should not extend into the upwardly curved shovel portion or end portion of the gliding board body so that it does not pose an obstacle to the relative movements between the ends of the plate-type force-transmitting element 13 and the gliding board body when this leaf spring-type packet comprising force-transmitting element 13 and gliding board body is subjected to a downward flexing or a lifting of the binding mounting portion or middle portions relative to the end portions. In particular, the upwardly curved shovel portion of the gliding board body would constitute a block with respect to the terminal end of the plate-type force-transmitting element 13 or inhibiting forces would occur if the plate-type force-transmitting element 13 were to extend in a straight line or also in an upwardly cambered arrangement into the shovel portion of the gliding board body. Especially if the plate-type force-transmitting element 13 extends across approximately two thirds to approximately nine tenths, for example across approximately three quarters, of the length of the gliding board body between the binding mounting centre point 15 and the respective end of the gliding board body or by reference to the total length of the gliding board body, a good ratio can be achieved between weight optimization and the stability or functionality of the gliding device 1 as a whole.

As may best be seen from FIGS. 1 and 3, the plate-type force-transmitting element 13 acts as a support for transmitting load, in particular for mounting a binding mechanism 3 for a user's shoe. In particular, a binding mechanism 3 is attached to the top face of the plate-type force-transmitting element 13 in a known manner. In a known manner, the binding mechanism 3 may comprise a front jaw and a heel jaw, which are connected to the top face of the plate-type force-transmitting element 13 either directly or via an interconnected guide rail arrangement. In order to connect the jaw bodies or the rail arrangement of the binding mechanism 3 to the top face of the force-transmitting element 13, at least one screw means 16, 17 is provided. In particular, an adequate connection can be achieved between the force-transmitting element 13 and the binding mechanism 3 by means of this least one screw means 16, 17, preventing any tearing out. The binding mechanism 3 is therefore supported with respect to the actual gliding board body with the plate-type force-transmitting element 13 connected in between.

As may best be seen by comparing FIGS. 1 and 4, it is expedient to provide at least one positively acting coupling means 19, 20 between the bottom face 18 of the plate-type force-transmitting element 13 and the top face 7 of the gliding board body. These positively acting coupling means 19, 20 between the bottom face 18 of the plate-type force-transmitting elements 13 and the top face 7 of the gliding board body, which are preferably disposed in pairs, extend essentially within a mounting zone for the binding mechanism 3, as may best be seen from FIG. 1. Within this mounting zone for a binding mechanism 3, the board-type gliding board body has its biggest thickness or width, as may be seen from FIG. 4, thereby enabling a sufficiently strong mutual positive connection or engagement between the plate-type force-transmitting element 13 and the gliding board body, as illustrated by way of example in FIG. 4.

The positively acting coupling means 19, 20 is designed so that it permits relative movements between the force-transmitting element 13 and the gliding board body in the longitudinal direction of the gliding board body to compensate for longitudinal movements when the gliding board body and the plate-type force-transmitting element 13 are subjected to flexing, as would be the case when travelling over mounds, for example. On the other hand, the positively acting coupling means 19, 20 is designed to prevent relative movements between the force-transmitting element 13 and the gliding board body in the transverse direction with respect to the longitudinal extension and essentially parallel with the running surface facing 10 of the gliding board body as far as possible and affords increased resistance against any such shifting tendencies. In other words, the at least one positively acting coupling means 19, 20 permits relative movements between the plate-type force-transmitting element 13 and the gliding board body in the longitudinal direction of the gliding board body but prevents lateral shifting movements between the plate-type force-transmitting element 13 and the top face 7 of the gliding board body, as may clearly be seen by comparing FIGS. 1 and 4. This partially positively acting connection between the plate-type force-transmitting elements 13 and the gliding board body is therefore conducive to achieving as direct and delay-free a transmission of forces as possible between the force-transmitting element 13 and the gliding board body without the bending behaviour of the gliding board body being impaired by the plate-type force-transmitting element 13.

The positively acting coupling means 19, 20 is preferably designed with at least one stud-type or strip-type projection 21, 22 on the bottom face 18 of the force-transmitting element 13, which locates in a co-operating or complementary recess 23, 24 in the top face 7 of the gliding board body and improves the mechanical coupling between said components. In one advantageous embodiment, however, the at least one but preferably two rows of stud-type or strip-type projections 21, 22 on the bottom face 18 of the force-transmitting element 13 may also serve as a means of accommodating the front portion, in particular the tip portion 25, of the screw means 16, 17 for attaching the binding mechanism 3 to the plate-type force-transmitting element 13. In particular, the front end or tip portion 25 of a screw means 16, 17 anchored in the force-transmitting element 13 for securing the binding mechanism 3 lies within these stud-type or strip-type projections 21, 22 on the bottom face 18 of the force-transmitting element 13. Above all, this provides a relatively strong anchoring for the screw means 16, 17, preventing them from being torn out, and hence a particularly reliable and strong enough connection for the binding mechanism 3 and its layered arrangement to the plate-type force-transmitting element 13 to prevent it from being torn out. The screw means 16, 17 described above, the tip portions 25 of which extend into the material of the projections 21, 22, may also be provided as a means of securing guide elements, in particular guide rails or so-called binding plates for the jaw bodies of the binding mechanism 3. The essential aspect is that a relatively long anchoring or screwing length exists within the plate-type force-transmitting element 13 if the at least one projection 21, 22 on the bottom face 18 of the force-transmitting element 13 is also advantageously used to increase the screwing-in depth for the screw means 16, 17, as may best be seen from FIG. 4.

Figure 2:
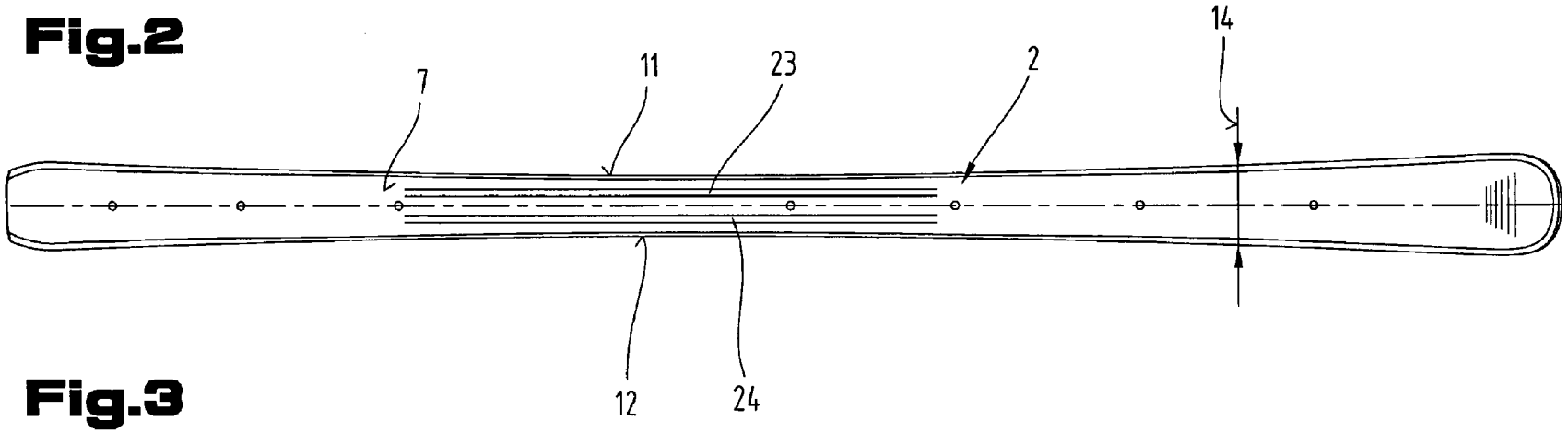
FIG. 2 is a simplified schematic plan view of the gliding board body illustrated in FIG. 1 without the plate-type force-transmitting element.

As may best be seen by comparing FIGS. 1, 2 and 4, a profile height 26 of the at least one, preferably strip-type projection 21, 22 becomes smaller starting from the binding mounting centre point 15 in the direction towards the rear and front end of the gliding board body continuously or in steps and preferably diminishes to zero. Similarly, a receiving depth 27 of the at least one, preferably groove-type recess 23, 24 becomes smaller starting from the binding mounting centre point 15 in the direction towards the rear and front ends of the gliding board body continuously or in steps and preferably also diminishes to zero. In other words, the at least one recess 23, 24 and the at least one projection 21, 22 co-operating with it extend out from the binding mounting centre point 15 in the direction towards the distal ends of the gliding board body and the plate-type force-transmitting element 13 and terminate before the ends of the gliding board body. For example, these projections 21, 22 become gradually flatter with respect to the bottom face 18 of the plate-type force-transmitting element 13, the greater distance they are away from the binding mounting centre point 15, and finally disappear altogether. However, the projections 21, 22 and/or the recesses 23, 24 co-operating with them may also terminate with a step. As may best be seen from FIGS. 1 and 2, the at least one recess 23, 24 in the top face 7 of the gliding board body extends across approximately one third of the length of the gliding board body, and it should be pointed out that this portion will also depend on the respective length of the different gliding board bodies, i.e. whether the gliding board body is relatively long or relatively short. Accordingly, the oppositely lying end portions of the recesses 23, 24 expediently merge flat or flush into the top face 7 of the gliding board body, as may be seen in particular from the perspective diagram shown in FIG. 1. The gliding board body therefore has the groove-type recesses 23, 24 in its middle portion in which the gliding board body has a sufficient or relatively large depth or thickness. At an increasing distance towards the binding mounting centre point 15, which is where the gliding board body usually has the biggest thickness or is at its thickest, the recesses 23, 24 will therefore have the biggest receiving depth 27, whereas the receiving depth 27 becomes continuously shorter towards the end portions of the gliding board body or reduces in steps and finally preferably diminishes to zero.

The essential thing is that the screw means 16, 17 for fixing the binding mechanism 3 are anchored solely within the plate-type force-transmitting element 13 and are not anchored in the gliding board body or screwed into the gliding board body disposed underneath. The ability of the plate-type force-transmitting element 13 and the gliding board body to move relative to one another is therefore maintained when said components flex about an axis extending transversely to its longitudinal direction. As schematically illustrated in FIG. 4, these screw means 16, 17 may also be used indirectly to secure the binding mechanism 3 and in particular the interconnected binding plate or a guide rail arrangement for the jaw bodies of the binding mechanism 3 on the plate-type force-transmitting element 13, preventing it from being torn off. In particular, it is expedient if the profile height 26 of the stud-type or strip-type projection 21, 22 and a plate height 28 of the plate-type force-transmitting element 13 are at least the same as or bigger than a screwing-in depth 29 of the screw means 16, 17 for securing the binding mechanism 3 and its components. As a result, the binding mechanism 3 or a requisite component of the binding mechanism 3 is connected exclusively to the plate-type force-transmitting element 13 fest without being directly or indirectly screwed to the gliding board body.

A mean height of thickness of the plate-type force-transmitting element 13 is between 0.5 and 3 cm. In particular, the thickness of the multi-layered, plate-type force-transmitting element 13 is between 50% and 150% of the thickness of the gliding board body within the binding mounting zone. In the case of the advantageous embodiment illustrated in FIG. 4, the height or thickness of the plate-type force-transmitting element 13 corresponds to approximately the height or thickness of the gliding board body within the same cross-sectional plane, in particular within the binding mounting zone. The total thickness or total height of the gliding device 1 comprising the assembled plate-type force-transmitting element 13 and actual gliding board body within the binding mounting zone is at most 5 cm, preferably 2 to 3 cm, as illustrated by way of example in FIG. 4. This relatively low height of the gliding device 1 and its strength or stiffness, which nevertheless satisfy practical requirements, are obtained due to a multi-layered, plate-type load-transmitting body, in particular by means of the plate-type force-transmitting element 13, which is coupled with the actual gliding board body by a least one positively acting coupling means 19, 20 in a conforming arrangement.

When the gliding device 1 is in the operation-ready state—FIG. 3—a binding mechanism 3 is mounted on the top face of the plate-type force-transmitting element 13. The screw means 16, 17—FIG. 1—for directly or indirectly retaining the binding mechanism 3 are anchored exclusively in the plate-type force-transmitting element 13. The plate-type force-transmitting element 13 is in turn connected to the actual gliding board body by separately provided connecting means 31 within the connecting zones 30 so that it can not be torn off—but is still elastically flexible—as will be explained below in connection with another feature. Preferably at a single point or within a relatively short longitudinal portion which is preferably disposed in the region of the binding mounting centre point 15, the plate-type force-transmitting element 13 is connected to the gliding board body rigidly and so that it can not move by means of at least one screw, as schematically illustrated in FIG. 1. At the oppositely lying end portions, which are mounted so that they are able to slide freely relative to the gliding board body disposed underneath, however, the plate-type force-transmitting element 13 is still able to move relative to the gliding board body in its longitudinal direction.

As also schematically illustrated in FIGS. 1 and 3, the plate-type force-transmitting element 13 is connected to the gliding board body by means of a plurality of connecting means 31 disposed within the co-operating connecting zones 30 spaced at a distance apart from one another in the longitudinal direction so that the plate-type force-transmitting element 13 is prevented from lifting off or detaching from the top face 7 of the gliding board body. Screw means may also be provided in the immediate vicinity of the binding mechanism 3, which connect the plate-type force-transmitting element 13 to the gliding board body lying underneath via elongate holes oriented parallel with the longitudinal direction of the force-transmitting element 13 so that different bending or chord lengths between said components can be compensated as far as possible unhindered.

As may be clearly seen from the diagram shown in FIG. 1, the gliding device 1 comprises at least two components supporting the user, in particular the plate-type force-transmitting element 13 and the gliding board body disposed underneath. The board-type gliding device 1 is therefore made up of at least two or several parts and said components are coupled with one another by means of positive connections and/or screw connections.

As may best be seen by comparing FIGS. 1 to 3, the plate-type force-transmitting element 13 is connected to the gliding board body at or in a plurality of connecting zones 30 spaced apart from one another in the longitudinal direction of the plate-type force-transmitting element 13. The number of these connecting zones 30 essentially depends on the total length of the plate-type force-transmitting element 13 and its strength or stiffness. In the embodiment illustrated as an example, seven connecting zones 30 are provided, by means of which the plate-type force-transmitting element 13, which may have a length of approximately 80 cm to approximately 180 cm depending on the length of the gliding board body disposed underneath, is connected to a gliding board body in a manner adapted accordingly, i.e. at least with a slightly bigger length. By preference, at least four connecting zones 30 are provided. The individual connecting zones 30 are positioned at a distance of approximately 15 cm to 30 cm apart in the longitudinal direction of the plate-type force-transmitting element 13. The distance between the individual connecting zones 30 may also vary in the longitudinal direction of the force-transmitting element 13, in particular in the direction towards the end portions, reducing to a value of approximately 15 cm, in order to optimize the interaction between the plate-type force-transmitting element 13 and the gliding board body. In at least one of these connecting zones 30, the plate-type force-transmitting element 13 and the gliding board body are connected to one another so that they can not tear apart or become detached from one another, thereby at least preventing the plate-type force-transmitting element 13 from lifting off the top face 7 of the gliding board body.

The essential thing is that within at least one connecting zone 30, an elastically flexible connecting means 31 is provided, which establishes an elastically flexible connection between the plate-type force-transmitting element 13 and the gliding board body. This being the case, the at least one elastically flexible connecting means 31 is designed so that it affords a resiliently rebounding elastic resistance to relative movements between the plate-type force-transmitting element 13 and the gliding board body caused by flexing or bending of the gliding board body. Such an elastically flexible connecting means 31 is disposed at least in the mutually opposite end portions of the plate-type force-transmitting element 13, as illustrated by way of example in FIG. 1. Naturally, it would also be possible to provide an elastically flexible connecting means 31 in all the connecting zones 30 to provide an elastically flexible and resiliently rebounding connection between the plate-type force-transmitting element 13 and the gliding board body.

Figure 5:
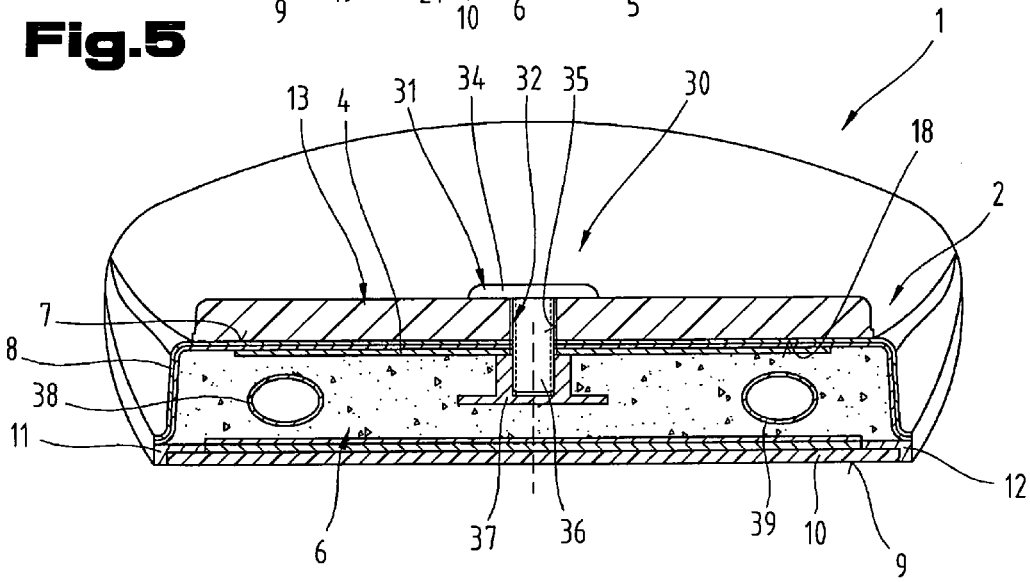
FIG. 5 shows the ski illustrated in FIG. 3, viewed in section along line V-V indicated in FIG. 3.
Figure 6:
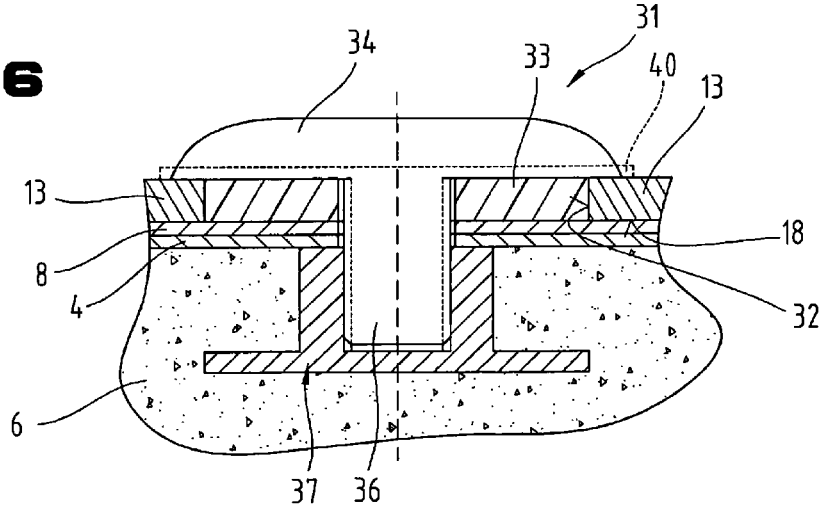
FIG. 6 is a highly simplified diagram in section showing a connecting zone between the plate-type force-transmitting element and the gliding board body on an enlarged scale.

In one advantageous embodiment illustrated by way of example in FIG. 6, the elastically flexible connecting means 31 has at least one elastomeric damping element 33 accommodated in an orifice 32 of the plate-type force-transmitting element 13. This elastomeric damping element 33 has a 3 fixing screw 4 extending through it in order to provide a connection between the plate-type force-transmitting element 13 and the gliding board body that can not be torn apart. The elastomeric damping element 33 is dimensioned and the fixing screw 34 positioned relative to the damping element 33 so that, by reference to the longitudinal direction of the plate-type force-transmitting elements 13, a part-portion of the elastomeric damping element 33 lies at least in front of and behind the fixing screw 34. By preference, the material of the elastomeric damping element 33 extends in a circle around the shaft of the fixing screw 34. Alternatively or in combination, however, it would also be possible, by reference to the longitudinal direction of the plate-type force-transmitting element 13, for the plate-type force-transmitting element 13 to lie to the left and right against the shaft of the fixing screw 34 and be supported so that it is able to slide relative to the shaft of the fixing screw 34. In this case, the orifice 32 in the plate-type force-transmitting element 13 is provided in the form of an oblong hole 35, in which case the width of this oblong hole 35 approximately corresponds to the diameter of the shaft of the fixing screw 34. The optional or combination embodiment of an orifice 32 in the plate-type force-transmitting element 13 in the form of an oblong hole 35 is illustrated by way of example in the diagrams of FIGS. 3, 5.

As may best be seen from FIGS. 5, 6, a tip portion 36, i.e. the portion of the fixing screw 34 remote from the head of the fixing screw 34, is screwed into a threaded insert 37, in particular into a so-called insert, which is at least partially integrated in the gliding board body. The threaded insert 37 is preferably positioned underneath the layers intended to impart strength, in particular underneath the top belt 4. By preference, a top peripheral portion of the threaded insert 37 is supported on the bottom face of the top belt 4 or on the bottom face of some other reinforcing element in the layered structure of the gliding board body so that it can transmit load. This ensures that the threaded insert 37 at least partially integrated in the gliding board body is particularly well secured so that it can not be torn out. In the embodiment illustrated as an example, the threaded insert 37 in the gliding board body extends into the core 6 of the gliding board body, and the core 6 is made from a hard foamed plastic, in particular a foamed polyurethane. However, the core 6 of the gliding board body may also comprise at least one extruded section. By preference, certain sections of two hollow sections 38, 39 are integrated in the gliding board body extending parallel with the longitudinal direction of the gliding board body, as illustrated by way of example in FIGS. 4, 5. It is particularly expedient to integrate threaded inserts 37 in the gliding board body, which threaded inserts 37 are positioned congruently with the connecting zones 30 of the plate-type force-transmitting element 13, if the core 6 of the gliding board body is made from foamed plastic, in particular foamed polyurethane. Especially if the core 6 is of a higher strength, for example made from wood, such threaded inserts 37 may also be dispensed with.

Especially if the diameter of the orifice 32 is relatively big or especially if the longitudinal extension of the elastomeric damping element 33 extends relatively widely, it is expedient to provide a pressure distribution element, in particular a seating washer 40, as indicated by broken lines in FIG. 6. In particular, at least certain parts of the orifice 32 in the plate-type force-transmitting element 13 may be bridged by a seating washer 40 for the head of the fixing screw 34. As a result, fixing screws 34 with a standard screw head and/or orifices 32 or elastomeric damping elements 33 with a relatively large surface extension may be used, and the plate-type force-transmitting elements 13 will still be reliably prevented from lifting off the top face 7 of the gliding board body by means of the seating washer 40.

Figure 7:
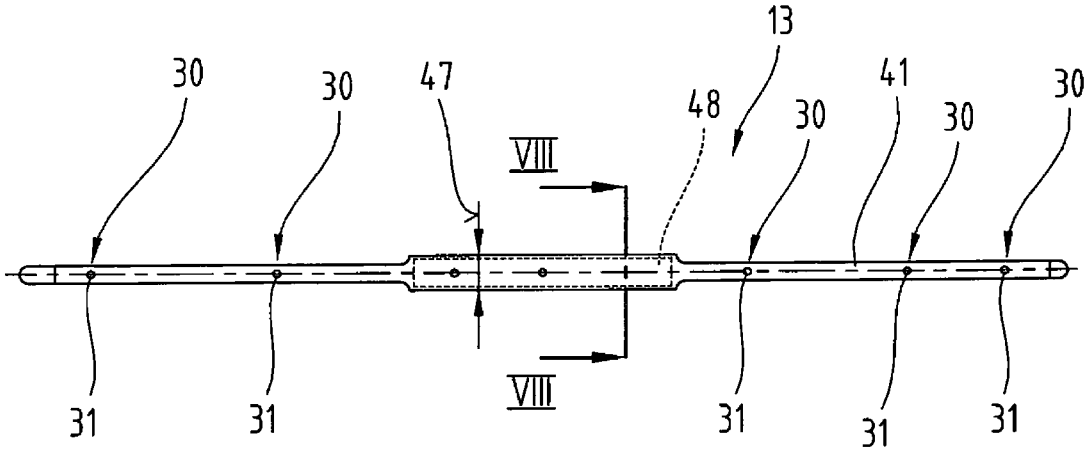
FIG. 7 is a simplified diagram showing a view from above of a different embodiment of a plate-type force-transmitting element.
Figure 8:
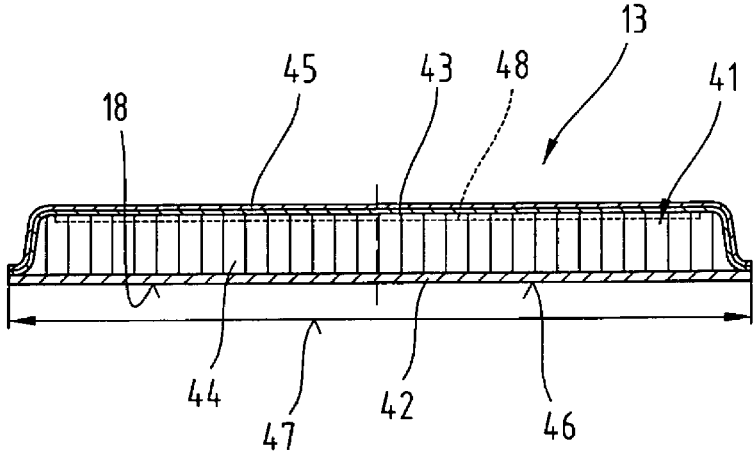
FIG. 8 is a simplified schematic diagram showing a cross-section of the plate-type force-transmitting element illustrated in FIG. 7, viewed in section along line VIII-VIII indicated in FIG. 7.

FIGS. 7, 8 are simplified diagrams illustrating an example of an advantageous embodiment of the plate-type force-transmitting element 13. The same reference numbers are used to describe parts already described above and the descriptions given above apply to the same parts denoted by the same reference numbers.

As clearly illustrated, like the gliding board body, the plate-type force-transmitting element 13 is also based on a multi-layered composite body 41, in particular a so-called sandwich compound element. In other words, the plate-type force-transmitting element 13 is made up of a plurality of layers adhesively joined to one another and, like the actual gliding board body, is manufactured by a hot pressing process using a heat press, in a known manner used for producing skis and snowboards or similar.

In particular, the plate-type force-transmitting element 13 in its function as a stabilizing and damping means of relatively large dimensions—FIG. 1—comprises at least one bottom belt 42 imparting strength, at least one top belt 43 imparting strength, at least one core element 44 disposed in between and at least one top layer 45 decorated on at least one side above the top belt 43 imparting strength. The bottom face 18 of the plate-type force-transmitting element 13 is formed by a gliding layer 46 made from plastic and the bottom face 18 of the plate-type force-transmitting element 13 is preferably designed as the gliding layer 46. This gliding layer 46 has a friction resistance which is lower than the top face 7 of the top layer 8 of the gliding board body or is as low as possible—FIG. 5. Compared with the top layer 8, the gliding layer 46 is as abrasion resistant as possible. The gliding layer 46 on the bottom face 18 of the plate-type force-transmitting element 13 may therefore be made from a thermoplastically formable plastic layer with similar properties to the surface or top layer 8 of the gliding board body and similar properties to the running surface facing 10 of the gliding board body—FIG. 5. However, the gliding layer 46 or bottom face 18 of the plate-type force-transmitting element 13 may also be formed by the bottom belt 42 of the plate-type force-transmitting element 13. This will be the case in particular if the bottom belt 43 is made from what is known as a prepreg, i.e. a fabric impregnated with heat-curable plastic resin.

The top layer 45 of the plate-type force-transmitting element 13, which is decorated on the internal face directed towards the core element 44 and/or on the external face facing away from the core element 44 or is intended to be decorated, preferably also extends across at least part-portions of the longitudinal side walls or so-called side faces of the plate-type force-transmitting element 13 forming the top covering surface of the plate-type force-transmitting element 13, as illustrated by way of example in FIG. 8.

In order to produce visual contrasts, the gliding layer 46, i.e. the bottom belt 42 or the corresponding prepreg material, is preferably coloured. Like the running surface facing 10—FIG. 5—of the gliding board body, the gliding layer 46 of the plate-type force-transmitting element 13 preferably also extends across the entire width 47 of the plate-type force-transmitting element 13, which width 47 preferably varies in the longitudinal direction of the force-transmitting element 13, as illustrated by way of example in FIG. 7. Also with regard to the longitudinal extension of the plate-type force-transmitting element 13, the gliding layer 46 preferably extends across the entire length of the force-transmitting element 13. In particular, the gliding layer 46 forms the bottom termination of the force-transmitting element 13 as it were, so that at least a major part of the bottom face 18 of the force-transmitting element 13 is formed by the gliding layer 46.

At least the predominant number of individual layers or elements of the multi-layered plate-type force-transmitting element 13 are formed and joined by means of a heat press, in particular in at least one heat pressing operation for the various layers and elements placed in a heatable pressing mould, in order to produce an integral, multi-layered composite body 41.

The at least one bottom belt 42 imparting strength and/or the at least one top belt 43 imparting strength incorporates at least one layer made from a so-called prepreg, i.e. a layer comprising a fabric impregnated with a plastic resin which melts when heated, for example a glass fibre fabric. The top belt 43 may also have an additional binding anchoring layer 48, as indicated by broken lines in FIGS. 7, 8. This binding anchoring layer 48 extends essentially within a part-portion of the force-transmitting element 13 where the binding mechanism 3 will subsequently be secured by screw means 16, 17—FIG. 1—directly or indirectly via guide rails or so-called binding support plates on the force-transmitting element 13. In addition to the prepreg layers imparting strength and stiffness, the bottom and/or top belt 42, 43 of the plate-type force-transmitting element 13 may also contain metal layers and/or strength-enhancing plastic layers, in a manner known from many designs which exist in the prior art.

The core element 44 of the plate-type force-transmitting element 13 may be made from an at least partially prefabricated Element of hard foamed plastic and/or from wood, for example. The core element 44 may optionally be surrounded, at least in certain portions, by a hose-type sleeve designed to improve the adhesive connection to the surrounding layers.

The sandwich-type structure of the multi-layered composite body 41 results in a plate-type force-transmitting element 13 with a relatively high torsional as well as shearing strength. The plate-type force-transmitting element 13 is therefore an essential component contributing to the bending behaviour and distribution of the bending strength of an assembled, ready-to-use gliding device 1, in particular an alpine or carving ski 2 produced accordingly, as illustrated by way of example in FIG. 3.

The performance which can be achieved using a ski 2 or snowboard proposed by the invention is therefore relatively high. In particular, the tracking and controllability of the specified ski 2 or snowboard is significantly improved and positively influenced. Furthermore, a high quality guiding action, in particular tracking stability are guaranteed, as well as a turning behaviour which can be anticipated by the user of the specified gliding device.

Figure 9:
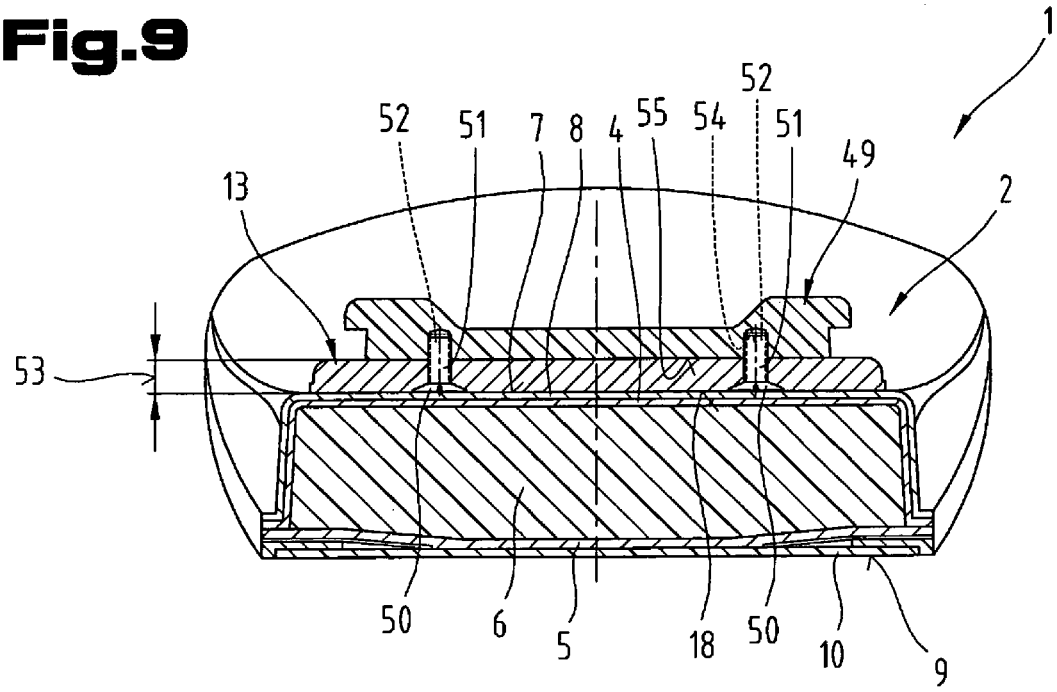
FIG. 9 is a simplified schematic diagram showing a cross-section of an embodiment for connecting a binding mechanism or its components to a plate-type force-transmitting element.

FIG. 9 is a highly simplified, schematic diagram in cross-section illustrating another embodiment of the board-type gliding device 1, and again, the same reference numbers are used for parts already described above so that the descriptions given above can also be applied to identical parts bearing the same reference numbers.

Here too, a plate-type force-transmitting element 13 is supported on the top face 7 of the gliding board body. The top face of the plate-type force-transmitting element 13 is used as a means of accommodating or retaining a binding mechanism 3—FIG. 1—or a rail arrangement 49 for providing a longitudinally displaceable retaining system or mount for the jaw bodies of a binding mechanism 3, in a manner commonly used in many embodiments known from the prior art.

Amongst other things, a connection is provided which is invisible to the user of the gliding device 1, in particular a covered screw connection between the binding mechanism 3 and its track arrangement 49 and the plate-type force-transmitting element 13. In particular, a head 50 of at least one binding screw 51 is provided, lying adjacent to the bottom face 18 of the plate-type force-transmitting element 13, the purpose of which is to secure a binding mechanism 3, in particular to secure its jaw bodies, rail arrangement 49 and/or binding plate. A tip portion 52 of the co-operating binding screw 51 opposite the head 50 of the at least one binding screw 51 is anchored in a jaw body, a rail arrangement 49 and/or in a binding plate of the binding mechanism 3—FIG. 1. Accordingly, the at least one binding screw 51 used to secure the binding mechanism 3 on the top face of the plate-type force-transmitting element 13, although it is preferable if several provided, is covered and hence invisible to a user of the gliding device 1 looking down onto the gliding device 1 from above. This firstly results in a harmonious appearance because the board-type gliding device 1 tends to look as though it were cast in a single piece. In addition to these design advantages, there are also technical effects, however, such as a particularly strong and break-proof connection between the plate-type force-transmitting element 13 and the binding mechanism 3—FIG. 1—for example. This reinforced or improved connection can also be achieved if the plate-type force-transmitting element 13 is of a relatively slim design and in particular has a relatively short plate height 53 in the region where the screw connection (s) to the binding mechanism 3—FIG. 1—or to its rail arrangement 49 is disposed. In particular, this means that the plate-type force-transmitting element 13 may have a plate height 53 of at most 2 cm, in particular 0.4 cm to 1.5 cm, preferably approximately 1 cm, in its binding mounting portion. Due to the type of connection described above, however, the plate-type force-transmitting element 13 and the connection between the plate-type force-transmitting element 13 and the binding mechanism 3—FIG. 1—are still sufficiently strong and stable. This is primarily due to the technical feature whereby the heads 50 of the binding screws 51 co-operate with the bottom face 18 of the plate-type force-transmitting element 13 or the head 50 of the at least one binding screw 51 is accommodated or supported in a co-operating indentation in the bottom face 18 of the plate-type force-transmitting element 13, as illustrated by way of example in the diagram shown in FIG. 9. However, the tip portion 52 of the at least one binding screw 51 of the binding mechanism 3—FIG. 1—and its components, such as the rail arrangement 49 for example, co-operates with or is screwed into its components.

Accordingly, the tip portion 52 of the at least one binding screw 51 is preferably anchored in a co-operating blind bore 54 in the bottom face 55 of the binding mechanism 3. In particular, the at least one blind bore 54 extends upwards in the vertical direction to where the tip portions 52 of the respective binding screws 51 are anchored, starting from the bottom face 55 of the binding mechanism 3 or its rail arrangement 49, as illustrated by way of example in FIG. 9. The co-operating blind bores 54 extending from the bottom face 55 of the binding mechanism 3—FIG. 1—or its rail arrangement 49 are therefore not provided in the form of orifices and are therefore not visible to the user of the corresponding gliding device 1, thereby giving or imparting the impression of a screwless fitting of the binding mechanism 3 on the plate-type force-transmitting element 13.

Figure 10:
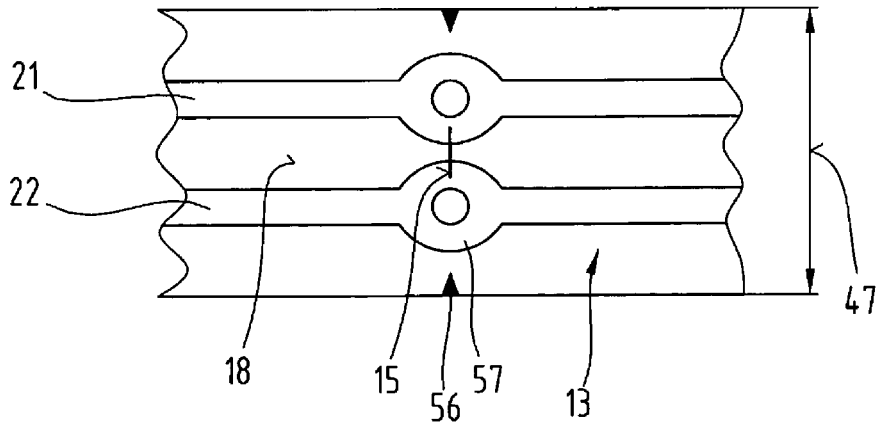
FIG. 10 is a simplified diagram showing a part-section of an example of the bottom face of a plate-type force-transmitting element.

FIG. 10 provides a schematic illustration of an example of one advantageous embodiment of the bottom face 18 of the plate-type force-transmitting element 13 in the region of the binding mounting centre point 15.

Disposed on the bottom face 18 of the plate-type force-transmitting element 13 are two strip-type projections 21, 22 extending parallel with one another, which are able to locate in at least approximately matching recesses 23, 24—FIG. 4—in the top face 7 of a gliding board body, as described above. By reference to the longitudinal direction of the plate-type force-transmitting element 13, the plate-type force-transmitting element 13 preferably has only one fixing point 56 or as short as possible a fixing zone with respect to the gliding board body to be fitted underneath. By preference, this fixing point 56 or this fixing zone is positioned close to the binding mounting centre point 15. At this fixing point 56 or within this narrow fixing zone, the plate-type force-transmitting element 13 can be rigidly connected to the gliding board body disposed underneath, preferably by screw means, so that it is essentially not able to flex in any direction. At this fixing point 56, therefore, all relative movements between the plate-type force-transmitting element 13 and the gliding board body are prevented. At an increasing distance from this fixing point 56, however, increasingly large relative movements between the plate-type force-transmitting element 13 and the gliding board body become possible when said components are subjected to flexing or bending.

At least one thicker region 57 or at least one narrower region may be provided at this fixing point 56 or as close as possible to this fixing point 56 on the bottom face 18 of the plate-type force-transmitting element 13, which can be positively coupled with a co-operating recess or raised area on the top face of the gliding board body. As a result, forces directed in the longitudinal direction of the force-transmitting element 13 with respect to the gliding board body can be better absorbed. In particular, it is of practical advantage to establish a positive connection in the region of the fixing point 56 by means of co-operating recesses or raised areas, which reliably prevents any relative movements between the force-transmitting element 13 and the gliding board body. Another advantage resides in the fact that the plate-type force-transmitting element 13 can simply be placed on the top face of the gliding board body during assembly and also positioned flat in the longitudinal direction, thereby simplifying the process of connecting or screwing said components during assembly. Another advantage of this positively acting connection resides in the fact that longitudinal forces or shearing or shifting forces can be partially absorbed by this positively acting connection and the entire load does not have to be absorbed by the screw-type fixing means. This means that the number of screw-type fixing means can be reduced or smaller ones can be used.

However, the bottom face 18 of the plate-type force-transmitting element 13 may also be of a planar or flat design, as illustrated in FIGS. 7, 8. This will be the case in particular if the connecting means 31—FIG. 1—or the screw connections between the plate-type force-transmitting element 13 and the gliding board body are sufficiently stable and/or are provided in a sufficiently large number.

The embodiments illustrated as examples represent possible design variants of the board-type gliding device 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

Above all, the individual embodiments of the subject matter illustrated in FIGS. 1, 2, 3, 4, 5, 6; 7, 8; 9; 10 constitute independent solutions proposed by the invention in their own right. The objectives and associated solutions proposed by the invention may be found in the detailed descriptions of these drawings.

| List of reference numbers | |
|---|---|
| 1 | Gliding device |
| 2 | Ski |
| 3 | Binding mechanism |
| 4 | Top belt |
| 5 | Bottom belt |
| 6 | Core |
| 7 | Top face |
| 8 | Top layer |
| 9 | Bottom face |
| 10 | Running surface facing |
| 11 | Control edge |
| 12 | Control edge |
| 13 | Force-transmitting element |
| 14 | Width |
| 15 | Binding mounting centre point |
| 16 | Screw means |
| 17 | Screw means |
| 18 | Bottom face |
| 19 | Coupling means |
| 20 | Coupling means |
| 21 | Projection |
| 22 | Projection |
| 23 | Recess |
| 24 | Recess |
| 25 | Tip portion |
| 26 | Profile height |
| 27 | Receiving depth |
| 28 | Plate height |
| 29 | Screwing-in depth |
| 30 | Connecting zone |
| 31 | Connecting means |
| 32 | Orifice |
| 33 | Damping element |
| 34 | Fixing screw |
| 35 | Oblong hole |
| 36 | Tip portion |
| 37 | Threaded insert |
| 38 | Hollow section |
| 39 | Hollow section |
| 40 | Seating washer |
| 41 | Composite body |
| 42 | Bottom belt |
| 43 | Top belt |
| 44 | Core element |
| 45 | Top layer |
| 46 | Gliding layer |
| 47 | Width |
| 48 | Binding anchoring layer |
| 49 | Rail arrangement |
| 50 | Head |
| 51 | Binding screw |
| 52 | Tip portion |
| 53 | Plate height |
| 54 | Blind bore |
| 55 | Bottom face |

-continued

| List of reference numbers | |
|---|---|
| 56 | Fixing point |
| 57 | Thicker region |

What is claimed is:

1. Ski or snowboard in the form of a board-type gliding device, with a multi-layered gliding board body at least comprising at least one top belt imparting strength, at least one bottom belt imparting strength, at least one core disposed in between, at least one top layer forming the top face of the gliding board body, at least one running surface facing forming the bottom face of the gliding board body, at least one force-transmitting element supported on the top face of the multi-layered gliding board body, the top face of which is provided as a means of supporting a binding mechanism for a connection to a sports shoe which can be released when necessary, and at least one stud-type or strip-type projection provided on a bottom face of the at least one force-transmitting element as a means of accommodating a tip portion of a screw means for the binding mechanism to provide a screwed anchoring at commencement of screwing in the screw means for at least one of jaw bodies, a rail arrangement and a binding plate of the binding mechanism, wherein the at least one force-transmitting element is of a plate-type design and extends across more than 50% of the length of the multi-layered gliding board body and is supported within its longitudinal extension in at least part-portions on the top face of the multi-layered gliding board body so as to transmit load and the at least one force-transmitting element is connected to the multi-layered gliding board body via a plurality of connecting zones spaced at a distance apart from one another in the longitudinal direction of the at least one force-transmitting element.

2. Ski or snowboard as claimed in claim 1, wherein an elastically flexible connecting means is provided within at least one connecting zone.

3. Ski or snowboard as claimed in claim 2, wherein the elastically flexible connecting means is designed so that it affords an elastically flexible and elastically rebounding resistance to relative movements between the at least one force-transmitting element and the multi-layered gliding board body caused by flexing or bending of the multi-layered gliding board body.

4. Ski or snowboard as claimed in claim 2, wherein the elastically flexible connecting means comprises a preferably elastomeric damping element accommodated in an orifice of the at least one force-transmitting element, through which a fixing screw extends in order to prevent the connection between the at least one force-transmitting element and the multi-layered gliding board body from working loose.

5. Ski or snowboard as claimed in claim 4, wherein a tip portion of the fixing screw is screwed into the multi-layered gliding board body, preferably in a threaded insert integrated in the multi-layered gliding board body.

6. Ski or snowboard as claimed in claim 4, wherein at least certain portions of the orifice in the at least one force-transmitting element are bridged by a seating washer for the head of the fixing screw.

7. Ski or snowboard as claimed in claim 1, wherein the at least one force-transmitting element extends from a binding mounting center point across more than 50% of the length as far as the rear end of the multi-layered gliding board body and across more than 50% of the length as far as the front end of the multi-layered gliding board body.

8. Ski or snowboard as claimed in claim 1, wherein the at least one force-transmitting element extends across 51% to 96% of the projected length of the multi-layered gliding board body.

9. Ski or snowboard as claimed in claim 1, wherein at least one positively acting coupling means is provided between the bottom face of the at least one force-transmitting element and the top face of the multi-layered gliding board body.

10. Ski or snowboard as claimed in claim 9, wherein the at least one positively acting coupling means extends more or less within a mounting zone for a binding mechanism.

11. Ski or snowboard as claimed in claim 9, wherein the at least one positively acting coupling means is designed so that it permits relative movements between the at least one force-transmitting element and the multi-layered gliding board body in the longitudinal direction of the multi-layered gliding board body due to flexing of the multi-layered gliding board body and prevents relative movements between the at least one force-transmitting element and the multi-layered gliding board body in the direction extending transversely to the longitudinal extension and essentially parallel with the running surface facing of the multi-layered gliding board body.

12. Ski or snowboard as claimed in claim 1, wherein a profile height of the stud-type or strip-type projection and a plate height of the at least one force-transmitting element are at least the same as or bigger than a screwing-in depth of a screw means for securing a binding mechanism.

13. Ski or snowboard as claimed in claim 1, wherein the at least one stud-type or strip-type projection locates in at least one co-operating recess in the top face of the multi-layered gliding board body.

14. Ski or snowboard as claimed in claim 13, wherein the at least one stud-type or strip-type projection is a strip-type projection and the at least one co-operating recess is a groove-type recess and a profile height of the strip-type projection and a receiving depth of the groove-type recess becomes shorter, continuously or in steps, starting from the binding mounting center point in the direction towards the rear and front ends of the multi-layered gliding board body and diminishes to zero.

15. Ski or snowboard as claimed in claim 1, wherein the head of a binding screw for securing a binding mechanism, in particular its jaw bodies, rail arrangement and/or binding plate, is anchored in a jaw body, a rail arrangement and/or in binding plate of the binding mechanism lying close to a bottom face of the at least one force-transmitting element and a tip portion of the binding screw remote therefrom.

16. Ski or snowboard as claimed in claim 15, wherein the tip portion of the binding screw is anchored in a blind bore in the bottom face of the binding mechanism, in particular its rail arrangement.

17. Ski or snowboard as claimed in claim 1, wherein the at least one force-transmitting element has a plate height in its binding mounting portion of 0.4 cm to 1.5 cm.

18. Ski or snowboard as claimed in claim 1, wherein the at least one force-transmitting element is formed by a multi-layered composite body comprising a plurality of layers adhesively joined to one another.

19. Ski or snowboard as claimed in claim 18, wherein the multi-layered composite body of the at least one force-transmitting element is produced by means of a heat press in at least one hot pressing operation for the individual layers.

20. Ski or snowboard as claimed in claim 1, wherein the at least one force-transmitting element comprises at least one bottom belt imparting strength, in particular at least one prepreg layer, at least one top belt imparting strength, at least one core element disposed in between and at least one top layer decorated on at least one side or intended to be decorated.

21. Ski or snowboard as claimed in claim 1, wherein the at least one force-transmitting element has an essentially concave contour at its two longitudinal side edges when the board-type gliding device is viewed from above.

22. Ski or snowboard as claimed in claim 1, wherein a bottom face of the at least one force-transmitting element is formed by a gliding layer made from plastic, which, compared with the top face of the top layer of the multi-layered gliding board body, is abrasion resistant and has a low frictional resistance.

* * * * *